US010390143B1

(12) United States Patent
Wakeland et al.

(10) Patent No.: US 10,390,143 B1
(45) Date of Patent: Aug. 20, 2019

(54) ELECTRO-ACOUSTIC TRANSDUCER FOR OPEN AUDIO DEVICE

(71) Applicant: Bose Corporation, Framingham, MA (US)

(72) Inventors: Ray Scott Wakeland, Marlborough, MA (US); Ryan C. Struzik, Hopkinton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/897,453

(22) Filed: Feb. 15, 2018

(51) Int. Cl.

| | |
|---|---|
| ***H04R 9/06*** | (2006.01) |
| ***H04R 9/02*** | (2006.01) |
| ***H04R 7/12*** | (2006.01) |
| ***H04R 1/28*** | (2006.01) |
| ***H04R 7/18*** | (2006.01) |
| *H04R 1/10* | (2006.01) |

(52) U.S. Cl.
CPC ..... *H04R 9/06* (2013.01); *H04R 1/2888* (2013.01); *H04R 7/12* (2013.01); *H04R 7/18* (2013.01); *H04R 9/025* (2013.01); *H04R 1/10* (2013.01)

(58) Field of Classification Search
CPC . H04R 9/06; H04R 9/025; H04R 7/12; H04R 1/2888; H04R 7/18; H04R 1/10; H04R 29/003; H04R 3/002; H04R 2499/11; H04R 1/1016; H04R 1/105; H04R 1/1066; H04R 1/1075; H04R 1/20; G01D 5/2417; H04M 1/03; H04M 1/035
USPC ..... 381/345, 346, 347, 348, 354
See application file for complete search history.

(56) References Cited

U.S. PATENT DOCUMENTS 4,742,887 A 5/1988 Yamagishi
4,852,683 A * 8/1989 Killion ..... A61F 11/10 181/130

(Continued)

FOREIGN PATENT DOCUMENTS

| | | | |
|---|---|---|---|
| EP | 2254346 | A2 | 11/2010 |
| EP | 2876898 | A2 | 5/2015 |
| JP | 018172691 | A | 7/1996 |

OTHER PUBLICATIONS

Unpublished U.S. Appl. No. 15/647,749, filed Jul. 12, 2017, entitled Audio Device; Applicant: Bose corporation.

(Continued)

*Primary Examiner* — Binh Kien Tieu
(74) *Attorney, Agent, or Firm* — Brian M. Dingman; Dingman IP Law, PC

(57) ABSTRACT

An electro-acoustic transducer with a diaphragm with a front side and a rear side, the diaphragm configured to radiate front side acoustic radiation from its front side and rear side acoustic radiation from its rear side. There is a magnet, and a magnetic circuit that defines a path for magnetic flux of the magnet and comprises a gap, wherein the magnetic circuit comprises a pole piece. A voice coil is located in the magnetic circuit gap and configured to move the diaphragm. A basket is supported by the magnetic circuit. The basket supports the diaphragm. There are first and second openings in the basket. The first and second basket openings are both configured to receive one of the front side acoustic radiation and rear side acoustic radiation. The first opening is spaced from the second opening. The first opening has a greater acoustic resistance than the second opening.

18 Claims, 3 Drawing Sheets

(56) References Cited

U.S. PATENT DOCUMENTS 5,173,575 A * 12/1992 Furukawa ..... H04R 1/2826 181/148
8,085,968 B2 * 12/2011 Silver ..... H04R 9/06 181/171
9,049,523 B2 * 6/2015 Bose ..... G01D 5/2417
9,241,227 B2 * 1/2016 Yamkovoy ..... G01D 5/2417
10,182,281 B2 * 1/2019 Igarashi ..... H04R 1/1016
2005/0123159 A1 * 6/2005 Matsuoka ..... H04M 1/03 381/312
2012/0177211 A1 * 7/2012 Yamkovoy ..... G01D 5/2417 381/59
2012/0177215 A1 * 7/2012 Bose ..... G01D 5/2417 381/74
2013/0343580 A1 * 12/2013 Lautenschlager ..... H04R 1/00 381/174
2013/0343593 A1 * 12/2013 Howes ..... H04R 1/1016 381/380
2014/0119556 A1 5/2014 Tanaka
2014/0334657 A1 11/2014 Godehard
2015/0110330 A1 * 4/2015 Howes ..... H04R 1/1016 381/380
2016/0227325 A1 8/2016 Pare
2017/0289667 A1 * 10/2017 Okita ..... H04R 1/1016
2017/0358291 A1 * 12/2017 Cheng ..... H04R 19/04
2018/0033419 A1 * 2/2018 Shetye ..... G10K 11/178
2018/0167710 A1 6/2018 Silver et al.

OTHER PUBLICATIONS

The International Search Report and The Written Opinion of the International Searching Authority dated May 23, 2019 for PCT Application No. PCT/US2019/018050.

* cited by examiner

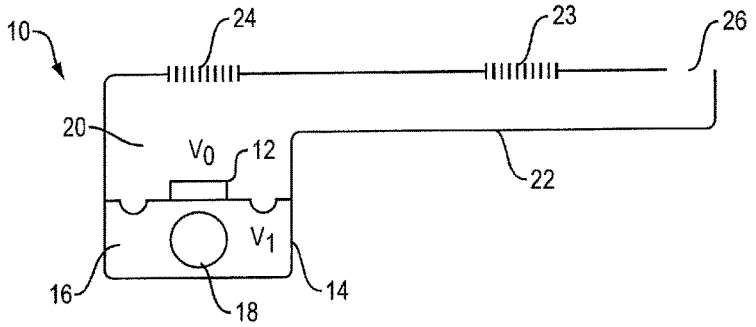
FIG. 1
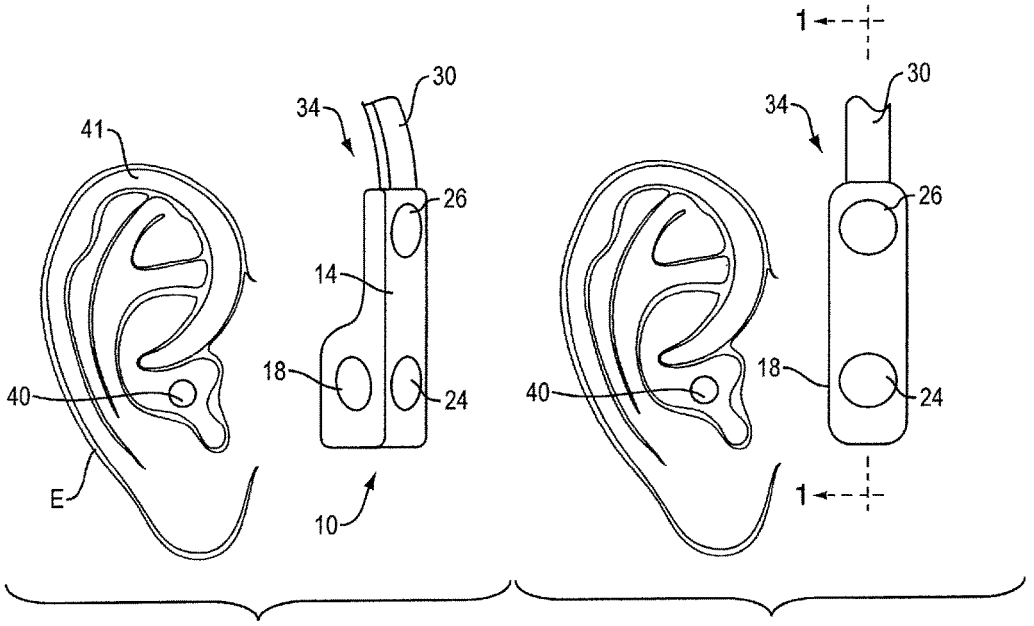
FIG. 2A
FIG. 2B

ELECTRO-ACOUSTIC TRANSDUCER FOR OPEN AUDIO DEVICE

BACKGROUND

This disclosure relates to an electro-acoustic transducer that is adapted to be used in open audio devices.

Open audio devices allow the user to be more aware of the environment, and provide social cues that the wearer is available to interact with others. However, since the acoustic transducer(s) of open audio devices are spaced from the ear and do not confine the sound to the just the ear, open audio devices produce more sound spillage that can be heard by others, as compared to on-ear headphones. Spillage can detract from the usefulness and desirability of open audio devices.

SUMMARY

All examples and features mentioned below can be combined in any technically possible way.

In one aspect, an electro-acoustic transducer includes a diaphragm with a front side and a rear side, the diaphragm configured to radiate front side acoustic radiation from its front side and rear side acoustic radiation from its rear side, a magnet, a magnetic circuit that defines a path for magnetic flux of the magnet and comprises a gap, wherein the magnetic circuit comprises a pole piece, a voice coil located in the magnetic circuit gap and configured to move the diaphragm, and a basket supported by the magnetic circuit. The basket directly or indirectly supports the diaphragm. There is a first opening in the basket and a second opening in the basket. The first and second basket openings are both configured to receive one of the front side acoustic radiation and rear side acoustic radiation. The first opening is spaced from the second opening, and the first opening has a greater acoustic resistance than the second opening.

Embodiments may include one of the following features, or any combination thereof. The first and second openings may both be configured to receive rear side acoustic radiation. The first and second openings may be on opposed sides of the transducer. The first opening may be covered by a resistive screen. The electro-acoustic transducer may further include a bobbin that is attached to the diaphragm and that carries the voice coil, wherein the bobbin comprises a plurality of openings that are adapted to transmit acoustic radiation through the bobbin.

Embodiments may include one of the above and/or below features, or any combination thereof. The electro-acoustic transducer may further include a port with a port opening, wherein the second opening leads to the port. The electro-acoustic transducer may further include a structure in the port that reduces port standing wave resonances. The port may be defined by port walls, and the structure in the port that reduces port standing wave resonances may comprise an opening in a port wall that is covered by a resistive screen. The diaphragm may have an apex and a periphery, and the apex may be closer to the voice coil than is the periphery. The electro-acoustic transducer may further comprise a roll coupled to the periphery of the diaphragm, wherein the roll is directly supported by the basket. The magnetic circuit may further comprise a front plate with a concave top surface.

Embodiments may include one of the above and/or below features, or any combination thereof. The magnetic circuit may comprise a cup-shaped pole piece. The diaphragm may have a diameter, and the cup-shaped pole piece may have a diameter that is at least as large as the diameter of the diaphragm. The basket may be coupled to and supported by the cup-shaped pole piece. The electro-acoustic transducer may further comprise a structure that defines a third opening, wherein the third opening is configured to receive the one of the front side acoustic radiation and rear side acoustic radiation that is not received by the first and second openings. The structure that defines the third opening may comprise the basket, and the third opening may be proximate the first opening.

In another aspect, an electro-acoustic transducer includes a diaphragm with a front side and a rear side, the diaphragm configured to radiate front side acoustic radiation from its front side and rear side acoustic radiation from its rear side, wherein the diaphragm has a diameter. There is a magnet, a magnetic circuit that defines a path for magnetic flux of the magnet and comprises a gap, wherein the magnetic circuit comprises a cup-shaped pole piece that has a diameter that is at least as large as the diameter of the diaphragm, and a voice coil located in the magnetic circuit gap and configured to move the diaphragm, wherein the voice coil is carried by a bobbin that is attached to the diaphragm. The bobbin comprises a plurality of openings that are adapted to transmit rear side acoustic radiation through the bobbin. A basket is coupled to and supported by the cup-shaped pole piece. The basket supports the diaphragm. A first opening in the basket is covered by a resistive screen. There is a second opening in the basket, and a port with a port opening, wherein the second opening leads to the port. The first and second basket openings are both configured to receive rear side acoustic radiation after it has been transmitted through the bobbin. The first opening is spaced from the second opening, and the first opening has a greater acoustic resistance than the second opening. The basket also defines a third opening that is configured to receive front side acoustic radiation.

In another aspect, an electro-acoustic transducer includes a diaphragm with a front side and a rear side, the diaphragm configured to radiate front side acoustic radiation from its front side and rear side acoustic radiation from its rear side, wherein the diaphragm has a diameter. There is a magnet, a magnetic circuit that defines a path for magnetic flux of the magnet and comprises a gap, wherein the magnetic circuit comprises a cup-shaped pole piece that has a diameter that is at least as large as the diameter of the diaphragm, and a voice coil located in the magnetic circuit gap and configured to move the diaphragm. A basket is coupled to and supported by the cup-shaped pole piece. The basket supports the diaphragm. A first opening in the basket is covered by a resistive screen. There is a second opening in the basket, a third opening in the basket, and a port with a port opening, wherein the second opening leads to the port. The first and second basket openings are both configured to receive rear side acoustic radiation. The first opening is spaced from the second opening, the first opening has a greater acoustic resistance than the second opening, and the third opening is proximate the first opening and is configured to receive front side acoustic radiation.

BRIEF DESCRIPTION OF THE DRAWINGS

FIG. 1 is partial, schematic, cross-sectional view of an electro-acoustic transducer taken along line 1-1 of FIG. 2B.

FIGS. 2A and 2B are front perspective and side views of the electro-acoustic transducer of FIG. 1 in use near an ear of a user.

DETAILED DESCRIPTION

Figure 3:
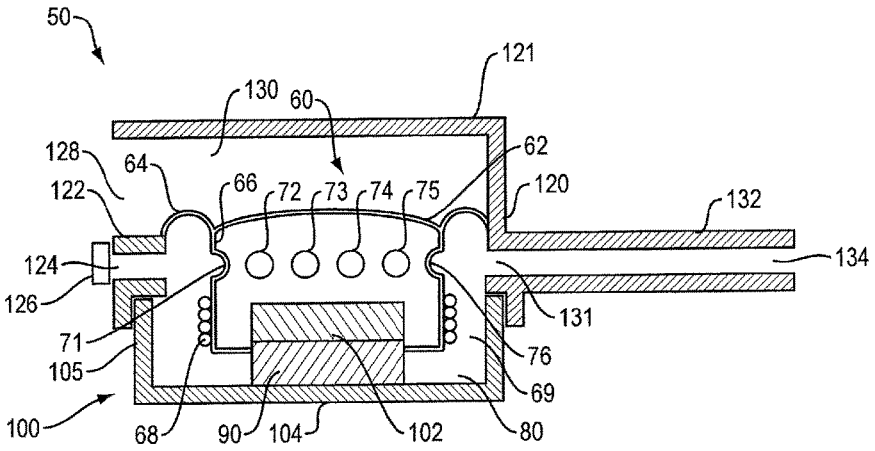
FIG. 3 is a cross-sectional view of an electro-acoustic transducer with low spillage.

The electro-acoustic transducer of the present disclosure can accomplish a variable-length dipole using sound-emitting openings directly in the basket. By using one of the basket openings as the resistive opening of a variable-length dipole transducer, and using another basket opening as the entrance into the mass port of the variable-length dipole transducer, the basket essentially becomes integrated with the transducer enclosure. This allows a larger, more efficient, driver to be used in a low-spillage open audio device, which can result in increased electroacoustic efficiency and thus better battery life. Also, integration of the basket and enclosure may allow for smaller total package volume for a given transducer size, thus providing for better ergonomics.

An electro-acoustic transducer includes an acoustic element (e.g., a diaphragm) that emits front-side acoustic radiation from its front side and emits rear-side acoustic radiation from its rear side. A housing or other structure directs the front-side acoustic radiation and the rear-side acoustic radiation. A plurality of sound-conducting vents in the structure allow sound to leave the structure. A distance between vents defines an effective length of an acoustic dipole of the transducer. The effective length may be considered to be the distance between the two vents that contribute most to the emitted radiation at any particular frequency. The structure and its vents are constructed and arranged such that the effective dipole length is frequency dependent. The electro-acoustic transducer is able to achieve a greater ratio of sound pressure delivered to the ear to spilled sound, as compared to a traditional transducer.

A headphone refers to a device that typically fits around, on, or in an ear and that radiates acoustic energy into the ear canal. This disclosure describes a type of open audio device with one or more electro-acoustic transducers that are located off of the ear. Headphones are sometimes referred to as earphones, earpieces, headsets, earbuds, or sport headphones, and can be wired or wireless. A headphone includes an electro-acoustic transducer driver to transduce audio signals to acoustic energy. The acoustic driver may be housed in an earcup. Some of the figures and descriptions following show a single open audio device. A headphone may be a single stand-alone unit or one of a pair of headphones (each including at least one acoustic driver), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality, such as a microphone.

In an around the ear or on the ear or off the ear headphone, the headphone may include a headband and at least one housing that is arranged to sit on or over or proximate an ear of the user. The headband can be collapsible or foldable, and can be made of multiple parts. Some headbands include a slider, which may be positioned internal to the headband, that provides for any desired translation of the housing. Some headphones include a yoke pivotally mounted to the headband, with the housing pivotally mounted to the yoke, to provide for any desired rotation of the housing.

An open audio device includes but is not limited to off-ear headphones (i.e., devices that have one or more electro-acoustic transducers that are coupled to the head but do not occlude the ear canal opening), and audio devices carried by the upper torso, e.g., the shoulder region. In the description that follows the open audio device is depicted as an off-ear headphone, but that is not a limitation of the disclosure as the electro-acoustic transducer can be used in any device that is configured to deliver sound to one or both ears of the wearer where there are no ear cups and no ear buds.

Exemplary electro-acoustic transducer 10 is depicted in FIG. 1, which is a schematic longitudinal cross-section. Electro-acoustic transducer 10 includes acoustic radiator (driver) 12 that is located within housing 14. Housing 14 is closed, or essentially closed, except for a number of sound-emitting openings or vents. The housing and its vents are constructed and arranged to achieve a desired sound pressure level (SPL) delivery to a particular location, while minimizing sound that is spilled to the environment. These results make electro-acoustic transducer 10 an effective off-ear headphone. However, this disclosure is not limited to off-ear headphones, as the electro-acoustic transducer is also effective in other uses such as body-worn personal audio devices, for example.

Housing 14 defines an acoustic radiator front volume 16, which is identified as "$V_1$," and an acoustic radiator rear volume 20, which is identified as "$V_0$." Electro-acoustic radiator 12 radiates sound pressure into both volume 16 and volume 20, the sound pressure to the two different volumes being out of phase. Housing 14 thus directs both the front side acoustic radiation and the rear side acoustic radiation. Housing 14 comprises three (and in some cases four or more) sound-emitting openings in this non-limiting example. Front opening 18, which could optionally be covered by a screen to prevent ingress of dust or foreign matter, can be located close to the ear canal opening. See FIG. 2A. Rear opening 24 would typically be covered by a resistive screen, such as a 46 Rayl polymer screen made by Saati Americas Corp., with a location in Fountain Inn, S.C., USA; the acoustic impedance of the screen would be selected to achieve a desired resistance in light of the details of the rear port design, the area of opening 24, and the desired crossover frequency between the long and short dipole lengths. Rear port opening 26 is located at the distal end of port (i.e., acoustic transmission line) 22; opening 26 could be covered by a screen to prevent ingress of dust or foreign matter. An acoustic transmission line is a duct that is adapted to transmit sound pressure, such as a port or an acoustic waveguide. A port and a waveguide typically have acoustic mass. Second rear opening 23 covered by a resistive screen is an optional passive element that can be included to damp standing waves in port 22, as is known in the art. Without screened opening 23, at the frequency where the port length equals half the wavelength, the impedance to drive the port is very low, which would cause air to escape through the port rather than screened opening 24. When we refer to an opening as resistive, we mean that the resistive component is dominant.

A front opening and a rear opening radiate sound to the environment outside of housing 14 in a manner that can be equated to an acoustic dipole. One dipole would be accomplished by opening 18 and opening 24. A second, longer, dipole would be accomplished by opening 18 and opening 26. An ideal acoustic dipole exhibits a polar response that consists of two lobes, with equal radiation forwards and backwards along a radiation axis, and no radiation perpendicular to the axis. Electro-acoustic transducer 10 as a whole exhibits acoustic characteristics of an approximate dipole, where the effective dipole length or moment is not fixed, i.e., it is variable. The effective length of the dipole can be considered to be the distance between the two openings that contribute the most to acoustic radiation at any particular frequency. In the present example, the variability of the dipole length is frequency dependent. Thus, housing 14 and openings 18, 24 and 26 are constructed and arranged such that the effective dipole length of transducer 10 is frequency dependent. Frequency dependence of a variable-length dipole and its effects on the acoustic performance of a transducer are further described below. The variability of the dipole length has to do with which openings dominate at what frequencies. At low frequencies opening 26 dominates over opening 24, and so the dipole length is long. At high frequencies, opening 24 dominates (in volume velocity) over opening 26, and so the dipole spacing is short.

One or more openings on the front side of the transducer and one or more openings on the rear side of the transducer create dipole radiation from the transducer. When used in an open personal near-field audio system (such as with off-ear headphones or a torso-worn device), there are two main acoustic challenges that are addressed by the variable-length dipole transducer of the present disclosure. Headphones or other personal audio devices should deliver sufficient SPL to the ear, while at the same time minimizing spillage to the environment. The variable length dipoles of the present transducers allow the device to have a relatively large effective dipole length at low frequencies and a smaller effective dipole length at higher frequencies, with the effective length relatively smoothly transitioning between the two frequencies. For applications where the sound source is placed near but not covering an ear, what is desired is high SPL at the ear and low SPL spilled to bystanders (i.e., low SPL farther from the source). The SPL at the ear is a function of how close the front and back sides of the dipole are to the ear canal. Having one dipole source close to the ear and the other far away causes higher SPL at the ear for a given driver volume displacement. This allows a smaller driver to be used. However, spilled SPL is a function of dipole length, where larger length leads to more spilled sound. For a personal audio device, in which the driver needs to be relatively small, at low frequencies driver displacement is a limiting factor of SPL delivered to the ear. This leads to the conclusion that larger dipole lengths are better at lower frequencies, where spillage is less of a problem because humans are less sensitive to bass frequencies as compared to mid-range frequencies. At higher frequencies, the dipole length should be smaller.

In some non-limiting examples herein, the electro-acoustic transducer is used to deliver sound to an ear of a user, for example as part of a headphone. An exemplary headphone 34 is partially depicted in FIGS. 2A and 2B. Electro-acoustic transducer 10 is positioned to deliver sound to ear canal opening 40 of ear E with pinna 41. Housing 14 is carried by headband 30, such that the acoustic radiator is held near but not covering the ear. An alternative to headband 30 would be a structure that was mounted to the ear. Other details of headphone 34 that are not relevant to this disclosure are not included, for the sake of simplicity. Front opening 18 is closer to ear canal 40 than are back openings 24 and 26. Opening 18 is preferably located anteriorly of pinna 41 and close to the ear canal, so that sound escaping opening 18 is not blocked by or substantially impacted by the pinna before it reaches the ear canal. As can be seen in the side view of FIG. 2B, openings 24 and 26 are directed directly away from the user's head. The area of the openings 18, 24, and 26 should be large enough such that there is minimal flow noise due to turbulence induced by high flow velocity. Note that this arrangement of openings is illustrative of principles herein and is not limiting of the disclosure, as the location, size, shape, impedance, and quantity of openings can be varied to achieve particular sound-delivery objectives, as would be apparent to one skilled in the art.

One side of the acoustic radiator (the front side in the non-limiting example of FIGS. 1 and 2) radiates through an opening that is typically but not necessarily relatively close to the ear canal. The other side of the driver can force air through a screen, or down a port. When the impedance of the port is high (at relatively high frequencies), acoustic pressure created at the back of the radiator escapes primarily through the screen. When the impedance of the port is low (at relatively low frequencies), the acoustic pressure escapes primarily through the end of the port. Thus, placing the screened vent closer than the port opening to the front vent accomplishes a longer effective dipole length at lower frequencies, and a smaller effective dipole length at higher frequencies. The housing and vents of the present loudspeaker are preferably constructed and arranged to achieve a longer effective dipole length at lower frequencies, and a smaller effective dipole length at higher frequencies. The variable-length dipole is thus frequency dependent.

Variable-length dipole electro-acoustic transducers are further disclosed in U.S. patent application Ser. No. 15/375,119, filed Dec. 11, 2016, the disclosure of which is incorporated herein by reference in its entirety. Further, in some examples there may also be a second opening in the front cavity (not shown) that is opposite opening 18 and that helps to reduce intermodulation in the front acoustic cavity, as disclosed in U.S. patent application Ser. No. 15/647,749, filed Jul. 12, 2017, the disclosure of which is incorporated herein by reference in its entirety.

Electro-acoustic transducer 50, FIG. 3, includes acoustic driver 60. The size, shape, and locations of the components of transducer 50 and driver 60 are illustrated schematically and in an actual device may be different than shown. As one example, gap 69 where voice coil 68 is located, is shown greatly enlarged, so that components and features of this example can be clearly seen. Driver 60 includes a diaphragm 62 with a front side and a rear side. Diaphragm 62 is configured to radiate front side acoustic radiation from its front side into front acoustic volume 130, and rear side acoustic radiation from its rear side into rear acoustic volume 80. Voice coil 68 is carried by former 66. In this non-limiting example, former 66 is a bobbin that is attached to diaphragm 62 at one end. Bobbin 66 locates voice coil 68 in a gap 69 in magnetic circuit 100 that includes front pole piece or front plate 102 and rear pole piece (cup) 104. Magnet 90 provides the magnetic flux that is guided by magnetic circuit 100 so as to interact with voice coil 68 and move diaphragm 62. The pole pieces and the voice coil gap are not to scale but rather are illustrated so as to convey the general arrangement. Magnetic circuits, voice coils, and diaphragms for electro-acoustic transducers are well known in the field and so will not be described herein in great detail.

Basket 120 is supported by upstanding wall 105 of cup 104 in this non-limiting example. Basket 120 supports the diaphragm via roll 64. Diaphragms and baskets are well-known components of electro-acoustic transducers and can have many different shapes and arrangements, as would be apparent to one skilled in the field. The present electro-acoustic transducer is not limited to any particular arrangement of the various elements that make up the transducer.

In most drivers that are configured to radiate sound pressure from both the front side and the rear side, in order for the rear side sound pressure to escape into the environment it must travel from the diaphragm, through the voice coil gap, and out of openings in the basket. The volume of the rear cavity and the nature of the openings through which the sound pressure must travel create a filter that has an effect on the performance of the driver. For example, small openings such as the voice coil gap result in a relatively high acoustic impedance, which acts as a low-pass filter. At high frequencies these impedances can greatly impact the driver's ability to radiate sound from the rear side.

In the present transducer 50, the rear-side acoustic resistance is reduced at least in part by including one or more openings in bobbin 66, such as openings 71-76. These openings provide flow path(s) for air flow from the rear side of diaphragm 62 into rear volume 80 that are in addition to the voice coil gap. The openings increase the overall size of the area of the air flow paths. The openings also may provide a more direct path to one or both of rear side openings 124 and 131, which lead to or are open to the environment as explained in more detail below. Note that the size, quantity, shape, and locations of the openings in the former, and the amount by which they decrease the acoustic impedance of the rear-side air flow, are not limiting of the scope of this disclosure.

Basket 120 in this example can also help to define one or both of the front acoustic cavity 60 and the rear acoustic cavity 80. In alternative arrangements, the basket can be fully or partially separate from a housing or other structure that defines some or all of either or both of the front and rear cavities.

Transducer 50 defines at least two spaced openings in one or both of the basket 120 and former (bobbin) 66, where the openings either directly or indirectly lead to the environment. In the present example, transducer 50 defines three openings 124, 128, and 134 that are directly open to the environment. Opening 124 is in portion 122 of basket 120. Opening 134 is at the end of port 132, which can be but need not be part of basket 120. Port 132 fluidly communicates with rear cavity 80 via opening 131 in basket 120. Port 132 may also include a screened opening along its length, or another structure to reduce port standing wave resonances (neither shown in this drawing), as in screened opening 23, FIG. 1. Openings 124 and 131 can be in opposed portions of basket 120 in one non-limiting example. Transducer 50 also includes openings 71-76 and 131 that are open to the rear side sound pressure but are not directly open to the environment, and so indirectly lead to the environment. Opening 128 can act as the vent or nozzle that is configured to provide sound most directly (from the front side of the diaphragm in this non-limiting example) to the ear, and can be equated to nozzle 18, FIGS. 1 and 2. Top basket wall 121 can define part of nozzle 128. Rear-side openings 124 and 134 accomplish the variable-length dipole, as described above, and can be equated to openings 24 and 26, respectively, FIGS. 1 and 2. Opening 124 is covered by a resistive mesh 126, or is otherwise configured so as to provide a greater acoustic resistance than one or preferably both of opening 134 and opening 128. Opening 134 is in port 132. In a non-limiting example, openings 124 and 128 are configured to be closer to the ear canal opening than is port opening 134.

Pole piece 104 in this non-limiting example has a generally hollow half-cylindrical shape (i.e., is cup-shaped), and a diameter that is larger than the diameter of diaphragm 62, such that the upstanding sidewall 105 of pole piece 104 is located adjacent to voice coil 68. Basket 120 is carried by sidewall 105. Thus, openings 124 and 128 can both be in the basket of the driver rather than in a housing that envelops the driver as in prior art transducers. Basket 120 can be made of plastic, and thus can easily be formed or produced (e.g., by injection molding) to have the desired openings, as opposed to a steel cup where openings to provide for rear-side airflow are more difficult to form, typically needing to be formed by drilling, stamping, or cutting.

By using one of the basket openings as the resistive opening of a variable-length dipole transducer, and using another basket opening as the entrance into the rear mass port of the variable-length dipole transducer, the basket essentially becomes integrated with the transducer enclosure. This allows a larger, more efficient, driver to be used in a low-spillage open audio device, which can result in increased electroacoustic efficiency and thus better battery life. Also, integration of the basket and enclosure may allow for smaller total package volume for a given transducer size, thus providing for better ergonomics.

Figure 4:
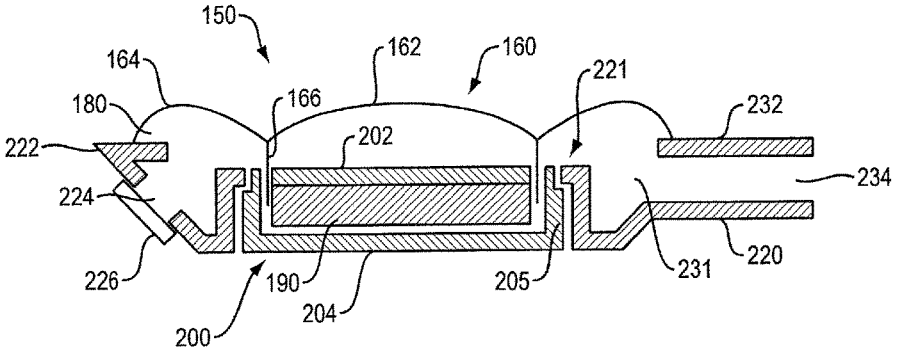
FIG. 4 is a cross-sectional view of an electro-acoustic transducer with low spillage.

FIG. 4 illustrates another alternative electro-acoustic transducer 150. Electro-acoustic transducer 150 includes acoustic driver 160. The size, shape, and locations of the components of transducer 150 and driver 160 are illustrated schematically and in an actual device may be different than shown. Driver 160 includes a diaphragm 162 with a front side and a rear side. Diaphragm 162 is configured to radiate front side acoustic radiation from its front side into a front acoustic volume (not shown), and rear side acoustic radiation from its rear side into rear acoustic volume 180. A voice coil (not shown, for the sake of ease of illustration) is carried either by the diaphragm or by former 166. In this non-limiting example, former 166 is attached to diaphragm 162 at one end. The voice coil is located in a gap in magnetic circuit 200 that includes front pole piece or front plate 202 and rear pole piece (cup) 204. Magnet 190 provides the magnetic flux that is guided by magnetic circuit 200 so as to interact with the voice coil and move diaphragm 162. The pole pieces and the voice coil gap are not to scale but rather are illustrated so as to convey the general arrangement. Magnetic circuits and voice coils for electro-acoustic transducers are well known in the field and so will not be described herein in great detail.

Basket 220 is directly supported by upstanding wall 205 of cup 204 in this non-limiting example. Basket 220 indirectly supports the diaphragm via roll 164. Diaphragms and baskets are well-known components of electro-acoustic transducers and can have many different shapes and arrangements, as would be apparent to one skilled in the field. The present electro-acoustic transducer is not limited to any particular arrangement of the various elements that make up the transducer.

Transducer 150 further defines at least two spaced openings 224 and 231 in basket 220, where the openings either directly or indirectly lead to the environment. In the present example, basket opening 224 is directly open to the environment. Opening 224 is in portion 222 of basket 220. Opening 234 is at the end of port 232 that is formed in basket 220. Port 232 fluidly communicates with rear cavity 180 via opening 231 in basket 220. Port 232 may also include a screened opening along its length, or another structure to reduce port standing wave resonances (not shown), as in screened opening 23, FIG. 1. Openings 224 and 231 can be in opposed portions of basket 220 in one non-limiting example. Note also that the front-side opening that acts as the vent or nozzle that is configured to provide sound most directly (from the front side of the diaphragm in this non-limiting example) to the ear, and can be equated to nozzle 18, FIGS. 1 and 2, is not shown in FIG. 4, simply for convenience of illustration. Rear-side openings 224 and 234 accomplish the variable-length dipole, as described above, and can be equated to openings 24 and 26, respectively, FIGS. 1 and 2. Opening 224 is covered by a resistive mesh 226, or is otherwise configured so as to provide a greater acoustic resistance than one or preferably both of opening 234 and the front nozzle opening. Opening 234 is in port 232. In a non-limiting example, opening 224 (and the nozzle) are configured to be closer to the ear canal opening than is port opening 234.

Pole piece 204 in this non-limiting example has a generally hollow half-cylindrical cup shape, and a diameter that is larger than the diameter of diaphragm 262, such that its upstanding sidewall 205 is located adjacent to the voice coil. Basket 220 is carried by sidewall 205 in any convenient manner, as illustrated at carry location 221 (e.g., with a shoulder in sidewall 205). Thus, openings 224 and 231 can both be in the basket of the driver rather than in a housing that envelops the driver as in prior art transducers. Basket 220 can be made of plastic, and thus can easily be formed or produced (e.g., by injection molding) to have the desired openings, as opposed to a steel cup where openings to provide for rear-side airflow are more difficult to form.

By using one of the basket openings as the resistive opening of a variable-length dipole transducer, and using another basket opening as the entrance into the rear port of the variable-length dipole transducer, the basket essentially becomes integrated with the transducer enclosure. This allows a larger, more efficient, driver to be used in a low-spillage open audio device, which can result in increased electroacoustic efficiency and thus better battery life. Also, integration of the basket and enclosure may further allow for smaller total package volume for a given transducer size, thus providing for better ergonomics.

Figure 5:
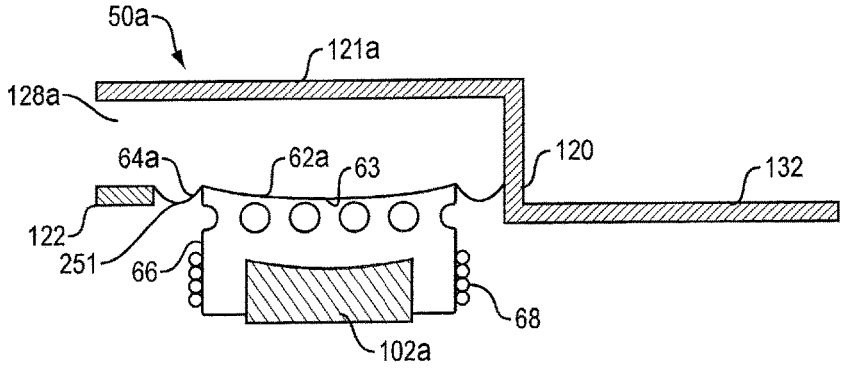
FIG. 5 is a partial cross-sectional view of an electro-acoustic transducer with low spillage.

FIG. 5 illustrates other features of the present disclosure. Electro-acoustic transducer 50*a* is extremely similar to transducer 50, FIG. 3. The differences between the two are illustrated in FIG. 5. In other words, most aspects of the two transducers that are the same are left out of FIG. 5, simply for ease and clarity of illustration. In transducer 50*a*, the diaphragm 62*a* and the roll 64*a* are inverted as compared to diaphragm 62 and roll 64, FIG. 3. Thus, the central location 63 of the diaphragm of transducer 50*a* is lower (i.e., closer to voice coil 68) than in the traditional arrangement of a diaphragm shown in FIG. 3, where the diaphragm is domed. Stated another way, central portion 63 is closer to voice coil 68 than is the periphery of diaphragm 62*a* where it meets roll 64*a*. Also, the central location 251 of roll 64*a* is lower (i.e., closer to voice coil 68) than in the traditional arrangement of a roll shown in FIG. 3. As depicted in FIG. 5, the front plate 102*a* may be modified such that its top surface is concave, in order to avoid interference with the inverted (concave) diaphragm as the diaphragm moves up and down. The inversion of the diaphragm and roll allow housing 120 top wall 121*a* to be located closer to bobbin 60 as compared to the arrangement of FIG. 3 and still leave nozzle 128*a* with a desired opening area. The transducer can thus have a reduced height as compared to transducer 50, FIG. 3, without losing efficiency.

A number of implementations have been described. Nevertheless, it will be understood that additional modifications may be made without departing from the scope of the inventive concepts described herein, and, accordingly, other embodiments are within the scope of the following claims.

What is claimed is:

1. An electro-acoustic transducer, comprising:

a diaphragm with a front side and a rear side, the diaphragm configured to radiate front side acoustic radiation from its front side and rear side acoustic radiation from its rear side;

a magnet;

a magnetic circuit that defines a path for magnetic flux of the magnet and comprises a gap, wherein the magnetic circuit comprises a pole piece;

a voice coil located in the magnetic circuit gap and configured to move the diaphragm;

a basket supported by the magnetic circuit, and wherein the basket directly or indirectly supports the diaphragm;

a first opening in the basket; and a second opening in the basket;

wherein the first and second basket openings are both configured to receive one of the front side acoustic radiation and rear side acoustic radiation, the first opening is spaced from the second opening, and the first opening has a greater acoustic resistance than the second opening.

2. The electro-acoustic transducer of claim 1, wherein the first and second openings are both configured to receive rear side acoustic radiation.

3. The electro-acoustic transducer of claim 1, wherein the first and second openings are on opposed sides of the transducer.

4. The electro-acoustic transducer of claim 1, wherein the first opening is covered by a resistive screen.

5. The electro-acoustic transducer of claim 1, further comprising a bobbin that is attached to the diaphragm and that carries the voice coil, wherein the bobbin comprises a plurality of openings that are adapted to transmit acoustic radiation through the bobbin.

6. The electro-acoustic transducer of claim 1, further comprising a port with a port opening, wherein the second opening leads to the port.

7. The electro-acoustic transducer of claim 6, further comprising a structure in the port that reduces port standing wave resonances.

8. The electro-acoustic transducer of claim 7, wherein the port is defined by port walls, and wherein the structure in the port that reduces port standing wave resonances comprises an opening in a port wall that is covered by a resistive screen.

9. The electro-acoustic transducer of claim 1, wherein the diaphragm has an apex and a periphery, and wherein the apex is closer to the voice coil than is the periphery.

10. The electro-acoustic transducer of claim 9, further comprising a roll coupled to the periphery of the diaphragm, wherein the roll is directly supported by the basket, and wherein the roll has an apex and a periphery, and wherein the apex is closer to the voice coil than is the periphery.

11. The electro-acoustic transducer of claim 9, wherein the magnetic circuit further comprises a front plate with a concave top surface.

12. The electro-acoustic transducer of claim 1, wherein the magnetic circuit comprises a cup-shaped pole piece.

13. The electro-acoustic transducer of claim 12, wherein the diaphragm has a diameter, and the cup-shaped pole piece has a diameter that is at least as large as the diameter of the diaphragm.

14. The electro-acoustic transducer of claim 13, wherein the basket is coupled to and supported by the cup-shaped pole piece.

15. The electro-acoustic transducer of claim 1, further comprising a structure that defines a third opening, wherein the third opening is configured to receive the one of the front side acoustic radiation and rear side acoustic radiation that is not received by the first and second openings.

16. The electro-acoustic transducer of claim 15, wherein the structure that defines the third opening comprises the basket, and wherein the third opening is proximate the first opening.

17. An electro-acoustic transducer, comprising:

a diaphragm with a front side and a rear side, the diaphragm configured to radiate front side acoustic radiation from its front side and rear side acoustic radiation from its rear side, wherein the diaphragm has a diameter;

a magnet;

a magnetic circuit that defines a path for magnetic flux of the magnet and comprises a gap, wherein the magnetic circuit comprises a cup-shaped pole piece that has a diameter that is at least as large as the diameter of the diaphragm;

a voice coil located in the magnetic circuit gap and configured to move the diaphragm, wherein the voice coil is carried by a bobbin that is attached to the diaphragm, wherein the bobbin comprises a plurality of openings that are adapted to transmit rear side acoustic radiation through the bobbin;

a basket coupled to and supported by the cup-shaped pole piece, and wherein the basket supports the diaphragm;

a first opening in the basket, wherein the first opening is covered by a resistive screen;

a second opening in the basket;

a port with a port opening, wherein the second opening leads to the port;

wherein the first and second basket openings are both configured to receive rear side acoustic radiation after it has been transmitted through the bobbin, the first opening is spaced from the second opening, and the first opening has a greater acoustic resistance than the second opening; and wherein the basket defines a third opening that is configured to receive front side acoustic radiation.

18. An electro-acoustic transducer, comprising:

a diaphragm with a front side and a rear side, the diaphragm configured to radiate front side acoustic radiation from its front side and rear side acoustic radiation from its rear side, wherein the diaphragm has a diameter;

a magnet;

a magnetic circuit that defines a path for magnetic flux of the magnet and comprises a gap, wherein the magnetic circuit comprises a cup-shaped pole piece that has a diameter that is at least as large as the diameter of the diaphragm;

a voice coil located in the magnetic circuit gap and configured to move the diaphragm;

a basket coupled to and supported by the cup-shaped pole piece, wherein the basket supports the diaphragm;

a first opening in the basket, wherein the first opening is covered by a resistive screen;

a second opening in the basket;

a third opening in the basket;

a port with a port opening, wherein the second opening leads to the port;

wherein the first and second basket openings are both configured to receive rear side acoustic radiation, the first opening is spaced from the second opening, the first opening has a greater acoustic resistance than the second opening, and the third opening is proximate the first opening and is configured to receive front side acoustic radiation.

* * * * *